US010072315B2

(12) United States Patent
Korecki et al.

(10) Patent No.: US 10,072,315 B2
(45) Date of Patent: Sep. 11, 2018

(54) DEVICE FOR INDIVIDUAL QUENCH HARDENING OF TECHNICAL EQUIPMENT COMPONENTS

(71) Applicant: SECO/WARWICK S.A., Świebodzin (PL)

(72) Inventors: Maciej Korecki, Świebodzin (PL); Wieslaw Fujak, Zbąszynek (PL); Józef Olejnik, Świebodzin (PL); Marek Stankiewicz, Zielona Góra (PL); Emilia Wołowiec-Korecka, Zgierz (PL)

(73) Assignee: SECO/WARWICK S.A., Swiebodzin (PL)

( * ) Notice: Subject to any disclaimer, the term of this patent is extended or adjusted under 35 U.S.C. 154(b) by 65 days.

(21) Appl. No.: 14/876,453

(22) Filed: Oct. 6, 2015

(65) Prior Publication Data

US 2016/0102377 A1 Apr. 14, 2016

(30) Foreign Application Priority Data

Oct. 6, 2014 (PL) ..... 409705

(51) Int. Cl.
*C21D 1/62* (2006.01)
*C21D 1/773* (2006.01)
(Continued)

(52) U.S. Cl.
CPC ..... *C21D 1/62* (2013.01); *C21D 1/613* (2013.01); *C21D 1/773* (2013.01); *C21D 9/32* (2013.01);
(Continued)

(58) Field of Classification Search
CPC ..... C21D 1/613; C21D 1/62; C21D 1/773; C21D 9/32; F27D 15/02; F27D 7/06; F27D 9/00; G06Q 10/063
USPC ..... 266/250, 251, 252, 103, 44, 259, 144; 432/128, 85; 148/316, 317, 325, 586, 148/626
See application file for complete search history.

(56) References Cited

U.S. PATENT DOCUMENTS 5,158,625 A * 10/1992 Lhote ..... C21D 1/613 148/625
5,452,882 A * 9/1995 Wunning ..... C21D 1/613 266/117

(Continued)

*Primary Examiner* — Scott Kastler
*Assistant Examiner* — Michael Aboagye
(74) *Attorney, Agent, or Firm* — Oliff PLC

(57) ABSTRACT

Device for individual quenching of gears, pinions, bearing rings and other similar components of technical devices, operating in a vacuum furnace installation, whereby the quenching chamber of the installation is fitted with tightly-sealed doors for workpiece loading and unloading. The following elements are fitted inside the quenching chamber: removable table on which an individual workpiece is placed, along with a surrounding set of removable nozzles; the inlet of the quenching chamber features an attached tank supplying the cooling medium to the nozzles—preferably air or nitrogen, or argon or helium, or hydrogen or carbon dioxide, or mixtures thereof—while the outlet of the quenching chamber is connected to the inlet of a tank receiving expanded cooling medium from the chamber; moreover, there is a compressor connected in between the two tanks, ensuring closed-loop flow of the cooling medium.

6 Claims, 1 Drawing Sheet

(51) Int. Cl.

| | |
|---|---|
| ***C21D 1/613*** | (2006.01) |
| ***C21D 9/32*** | (2006.01) |
| ***F27D 7/06*** | (2006.01) |
| ***F27D 9/00*** | (2006.01) |
| ***F27D 15/02*** | (2006.01) |

(52) U.S. Cl.
CPC ..... *F27D 7/06* (2013.01); *F27D 9/00* (2013.01); *F27D 15/02* (2013.01)

(56) References Cited

U.S. PATENT DOCUMENTS

| | | | | |
|---|---|---|---|---|
| 7,033,446 | B2 * | 4/2006 | Poor | C23C 8/22 148/223 |
| 7,150,777 | B2 * | 12/2006 | Alcantara | C21D 1/76 266/144 |
| 7,632,453 | B2 * | 12/2009 | Chaffotte | C21D 1/613 148/233 |
| 2002/0104589 | A1 * | 8/2002 | Van den Sype | C21D 1/613 148/233 |

* cited by examiner

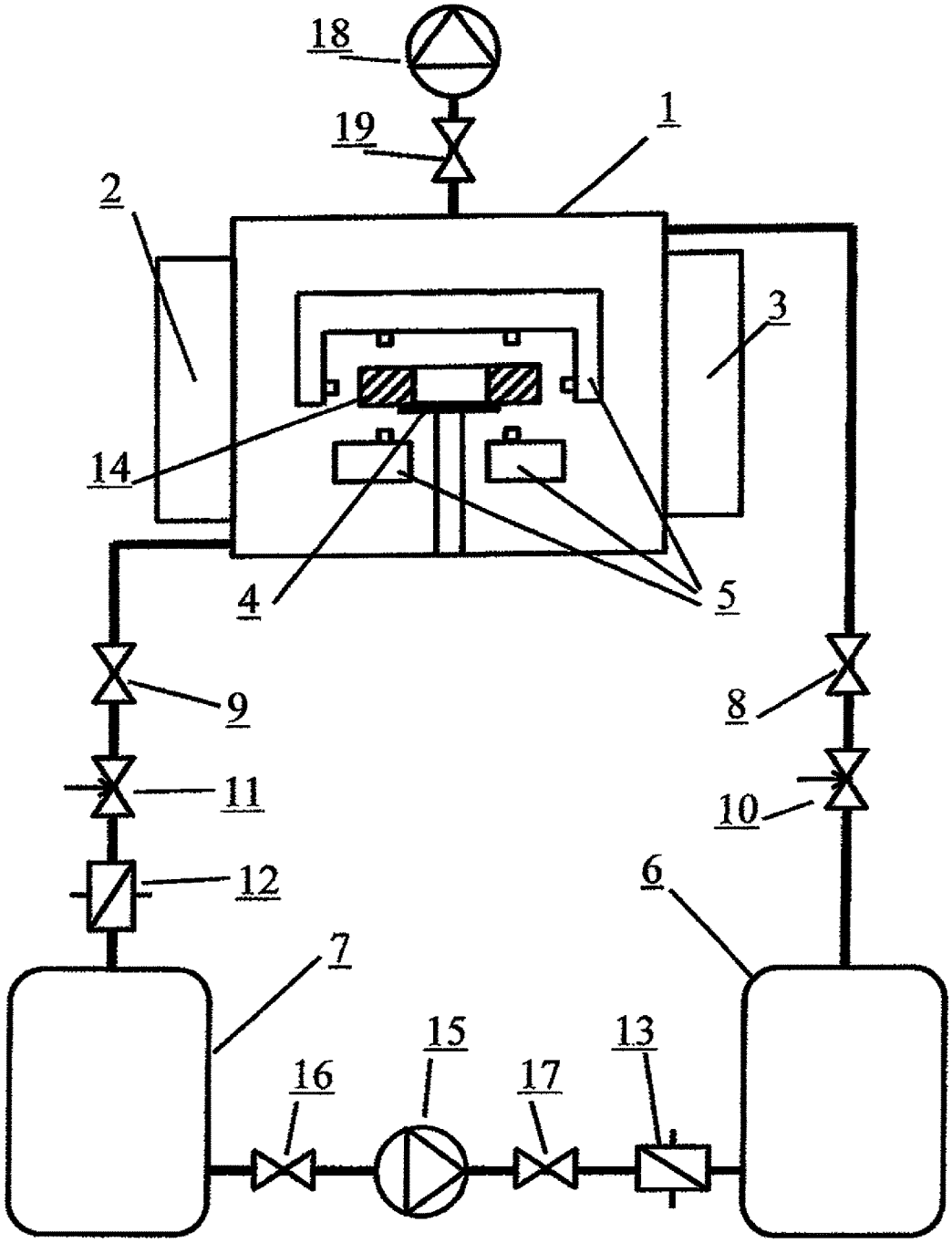
18
19
1
2
3
14
4
5
9
8
11
10
12
6
7
15
13
16
17

DEVICE FOR INDIVIDUAL QUENCH HARDENING OF TECHNICAL EQUIPMENT COMPONENTS

BACKGROUND

A subject matter of an invention is a device for individual quench hardening of technical equipment components, i.e. for controlled hardening of individual components using a cooling medium, aiming to minimize deformation.

Quenching is a heat treatment process applied to steel, consisting in the rapid cooling of workpieces from the austenitizing temperature down to near-ambient temperature. Quench hardening results in the transformation of steel microstructure and improvement of both mechanical and usable properties, e.g. durability, hardness, wear resistance, etc.

Various existing solutions involve quenching conducted in dedicated devices or quenching chambers, in different liquid cooling media, such as: oil, water, salt or—less frequently—in gases or air. For the time being, oil remains the most common quenching medium.

Quench-hardened workpieces are usually arranged in batches on dedicated equipment (trays, baskets, etc.), constituting so-called workloads, or they are placed in bulk on conveyor belts to be heated in furnaces up to the austenitizing temperature, and hardened in quenching devices. Quenching devices may be integral elements of austenitizing furnaces or separate, independent solutions.

A characteristic feature of all quenching devices is the presence of a unit designed for ensuring forced circulation of the cooling fluid—mixer in the case of liquids, and fans in the case of gases. Forced circulation of the cooling medium is necessary for effective transferring of heat from quenched workpieces to the heat exchanger, which—in turn—directs heat outside of the quenching device (usually using water or another external cooling medium). Consequently, the presence of one or more heat exchangers is also characteristic in classic quenching devices.

In conventional quench hardening devices the process proceeds as follows: after being heated to the austenitizing temperature, the workload is transported from the furnace to the quenching device in which cooling fluid absorbs heat, thus cooling the workload. Next, the cooling fluid (heated by the workload) is directed to the heat exchanger where it is cooled and redirected towards the workload to absorb heat. Optimum flow of the cooling fluid is ensured by mixers (for liquids) and fans (for gases), being directed by appropriate stators and ducts.

In addition to obtaining proper mechanical properties, in the quench hardening process it is important to minimize deformation caused by stresses resulting from temperature gradients and by transformation of material structure during quenching. Deformations require costly machining to smooth out the shape of individual elements, and therefore the goal is to minimize deformation and achieve maximum repeatability.

Theoretically, minimization of deformation can be achieved by providing identical and uniform cooling conditions both for a single workpiece and for all workpieces (which is particularly important in mass production). Conventional oil quenching results in increased deformation due to the three-phase nature of the process (steam cushion, bubble and convection phases) and the related non-uniform intensity of heat absorption. Similarly, it is not an optimum solution to arrange individual elements in batch workloads, because each workpiece—due to its unique position in the workload—undergoes the hardening process in a unique, different manner, eventually exhibiting deformation differing from other workpieces.

Given the above disadvantages of conventional quenching devices—in terms of minimization and repeatability of deformation—works have been initiated to develop a device for repeatable hardening of individual workpieces in a cooling medium.

SUMMARY

The essential feature of the device for individual quenching—constituting the present invention—consists of the following elements being situated inside the quenching chamber: removable table on which an individual workpiece is placed, along with a surrounding set of removable nozzles; the inlet of the quenching chamber features an attached tank supplying the cooling medium to the nozzles, while the outlet of the quenching chamber is connected to the inlet of a tank receiving expanded cooling medium from the chamber; moreover, there is a compressor connected in between the two tanks, ensuring closed-loop flow of the cooling medium.

Advantageously, the following items are connected in between the tank outlet and the quenching chamber inlet: controller for adjusting feed gas flow rate and a shut-off valve; while the following items are preferably fitted in between the outlet of the quenching chamber and the tank inlet: shut-off valve, controller for adjusting received gas flow rate, and a heat exchanger for cooling the cooling medium heated during the quenching process.

Advantageously, tank outlet is connected to the compressor inlet via shut-off valve, while compressor outlet is connected to tank inlet via shut-off valve and heat exchanger for cooling the compressed medium.

Further, it is beneficial when the quenching chamber is connected—via shut-off valve—with the inlet of a vacuum pump set to enable air removal and loading of quenching chamber 1 under vacuum conditions.

Advantageously, the placement and parameters of the removable table and the surrounding nozzle set are each time adjusted to the shape of the workpiece cooled down in the quenching process, owing to which a uniform and optimum inflow of the cooling medium is obtained, preferably air or nitrogen, or also argon or helium, or hydrogen or carbon dioxide, or mixtures thereof.

The device according to the invention enables controlled cooling of the workpiece subject to quenching by withholding—for a specified time—the enforced flow of the cooling medium at any given point during the cooling process, and resuming the flow afterwards, at various flow and pressure conditions, repeated once or several times. This method allows to: freely shape the cooling curve, achieve optimum microstructure and mechanical properties of steel, and eliminate the tempering process (which is usually necessary after hardening).

The application of controlled quenching of individual workpieces results in minimized deformation of each workpiece as well as full repeatability of deformation for all items of the same type, at the same time offering extraordinary mechanical properties.

The invention is described below in greater detail, taking the example of a specific executed model.

BRIEF DESCRIPTION OF THE DRAWINGS

FIG. 1 shows a quenching chamber with a cooling system.

LIST OF INDICATIONS IN DRAWING

1. Quenching chamber
2. Loading door
3. Unloading door
4. Table
5. Nozzles
6. Tank supplying the cooling medium to the nozzles
7. Tank receiving expanded cooling medium from the quenching chamber
8. Shut-off valve
9. Shut-off valve
10. Controller
11. Controller
12. Heat exchanger
13. Heat exchanger
14. Workpiece subject to quench hardening
15. Compressor
16. Shut-off valve
17. Shut-off valve
18. Vacuum pump system
19. Shut-off valve

DETAILED DESCRIPTION OF THE DRAWINGS

The device according to the invention operates in a continuous vacuum furnace installation with separate vacuum chambers for heating and carburizing, diffusion, pre-cooling and quenching. Quenching chamber 1—fitted with tightly closing doors 2 and 3, designed for workpiece 14 loading and unloading, situated opposite each other—is connected via shut-off valve 19 with the inlet of vacuum pump system 18 to enable air removal and loading of the quenching chamber 1 in vacuum conditions.

The following items are fitted inside the quenching chamber 1: removable table 4 on which an individual workpiece 14 is placed, surrounded by a set of removable nozzles 5. Attached to the inlet of the quenching chamber 1, there is the tank 6 supplying the cooling medium to the nozzles 5, whereas the outlet of the quenching chamber 1 is connected to the inlet of the tank 7 that collects expanded cooling medium from the quenching chamber 1. Moreover, connected between tanks 7 and 6 there is a compressor 15 ensuring closed-loop flow of the cooling medium.

The placement and parameters of the removable table 4 and the surrounding set of removable nozzles 5 are each time adapted to the shape of the workpiece 14 subject to cooling during the quenching process, which offers uniform and optimum inflow of the cooling medium.

The following items are connected in between the outlet of the tank 6 and the inlet of the quenching chamber 1: controller 10 for adjusting feed gas flow rate and a shut-off valve 8; while the following items are preferably fitted in between the outlet of the quenching chamber 1 and the inlet of the tank 7: shut-off valve 9, controller 11 for controlling received gas flow rate, and a heat exchanger 12 for cooling the cooling medium heated during the quenching process.

The outlet of the tank 7 is connected to the inlet of the compressor 15 via shut-off valve 16, while the outlet of the compressor 15 is connected to tank 6 inlet via shut-off valve 17 and heat exchanger 13 for cooling the cooling medium.

In the example under discussion, in the quenching chamber 1 made of machinery steel there is the workpiece 14 subject to thermal processing—a 150 mm gear made of 20MnCr5 carburizing steel; nitrogen is applied as the cooling medium.

After heating in the furnace and carburizing to the required layer thickness at a temperature above the austenitizing temperature (e.g. 950° C.), the workpiece 14 is transferred in vacuum to the quenching chamber 1. Meanwhile, vacuum of at least 0.1 hPa is achieved in the quenching chamber 1 using the vacuum system 18, with the valve 19 open. Next, after opening the loading door 2, the workpiece 14 is transferred by a transporting mechanism or a manipulator to the quenching chamber 1, where it is placed on the table 4. The loading door 2 and the vacuum valve 19 are closed. Next, the valve 8 at gas inlet to the quenching chamber 1 is opened, and so is the valve 9 at gas outlet. Cooling gas from the feeding tank 6 flows to the nozzles 5 at 2 MPa, being directed on the workpiece 14 subject to quenching. The gas absorbs heat from the workpiece 14—thus cooling it—and when heated it flows to the receiving tank 7, at ambient pressure. Before entering the tank 7, the gas is cooled in the gas-gas (nitrogen-air) heat exchanger 12. Cooling gas flow rate (and hence cooling speed) is adjusted by controllers 10 and 11 that also set gas pressure in the quenching chamber 1. As the pressure inside the receiving tank 7 rises to 0.1 MPa, the compressor 15 is engaged, shut-off valves 16 and 17 open, and the gas is pumped back to the feeding tank 6 (through the other heat exchanger 13), which closes the cooling gas loop. After a few dozen seconds, the workpiece 14 is quenched and cooled to a temperature enabling unloading—usually under 200° C. After the shut-off valve 8 is closed and the pressure in the quenching chamber 1 decreases to near-ambient level, the shut-off valve 9 and the stopped compressor 15 are both closed. At the same time, shut-off valves 16 and 17 are closed as well. Next, unloading door 3 opens and the workpiece 14 can be removed from the quenching chamber 1—by a transporting mechanism or a manipulator. As a result of a process conducted in the above-described manner, the workpiece 14 is properly quenched, achieving hardness levels of 60-62 HRC on the surface and 32-34 HRC in the core. Further, after closing door 3, vacuum is created in the quenching chamber 1 (at 0.1 hPa), and another workpiece 14 can be loaded to proceed with another quenching cycle, each cycle duration ranging between 10 and 1000 s.

The application of gas as a cooling medium allows to achieve uniform cooling (a single-phase process based on convection exclusively) and full control of process intensity by adjusting gas density or flow speed. Quench hardening of individual elements offers precise adjustment of cooling gas flow to workpiece shape, and perfect repetition of cooling conditions for each workpiece in mass production.

The invention claimed is:

1. A device for individual quenching of a workpiece in a vacuum furnace installation, the workpiece including gears, pinions, bearing rings, and other similar components of technical devices, the device comprising:

a quenching chamber that is fitted with tightly-sealed doors for loading and unloading the workpiece, the quenching chamber being coupled, via a shut-off valve, to an inlet of a vacuum pump, the vacuum pump being configured to enable loading and removal of air to and from the quenching chamber under vacuum conditions, a removable table being disposed inside the quenching chamber and being configured to receive the workpiece, and a set of removable nozzles being disposed inside the quenching chamber and being configured to surround the workpiece, a first tank that is used to supply cooling medium to the nozzles, the first tank being connected to an inlet of the quenching chamber via a first controller that adjusts a feed gas flow rate, a second tank that collects expanded cooling medium from the quenching chamber, the second tank being connected to an outlet of the quenching chamber via a second controller that adjusts a feed gas flow rate, and a compressor that is connected to the first tank via a first heat exchanger and to the second tank via a second heat exchanger, the compressor ensuring closed-loop flow of the cooling medium between the first tank and the second tank.

2. The device according to claim 1, wherein a second shut-off valve is disposed between the outlet of the quenching chamber and an inlet of the second controller.

3. The device according to claim 1, wherein a third shut-off valve is disposed between an outlet of the first tank and an inlet of the compressor.

4. The device according to claim 1, wherein a fourth shut-off valve is disposed between an outlet of the compressor and an inlet of the second heat exchanger.

5. The device according to claim 1, wherein a fifth shut-off valve is disposed between an outlet of the first controller and the inlet of the quenching chamber.

6. The device according to claim 1, wherein the cooling medium is air, nitrogen, argon, helium, hydrogen, or carbon dioxide, or mixtures thereof.

* * * * *